US011721479B2

(12) United States Patent
Yokota et al.

(10) Patent No.: US 11,721,479 B2
(45) Date of Patent: Aug. 8, 2023

(54) RARE EARTH MAGNETS

(71) Applicants: TOYOTA JIDOSHA KABUSHIKI KAISHA, Toyota (JP); THE UNIVERSITY OF TOKYO, Tokyo (JP)

(72) Inventors: Kazuya Yokota, Sunto-gun (JP); Tetsuya Syoji, Susono (JP); Noritsugu Sakuma, Mishima (JP); Takashi Miyake, Tsukuba (JP); Yosuke Harashima, Tsukuba (JP); Hisazumi Akai, Tokyo (JP); Naoki Kawashima, Tokyo (JP); Keiichi Tamai, Tokyo (JP); Munehisa Matsumoto, Tokyo (JP)

(73) Assignees: TOYOTA JIDOSHA KABUSHIKI KAISHA, Toyota (JP); THE UNIVERSITY OF TOKYO, Tokyo (JP)

( * ) Notice: Subject to any disclaimer, the term of this patent is extended or adjusted under 35 U.S.C. 154(b) by 0 days.

(21) Appl. No.: 17/000,796

(22) Filed: Aug. 24, 2020

(65) Prior Publication Data

US 2021/0065973 A1 Mar. 4, 2021

(30) Foreign Application Priority Data

Aug. 29, 2019 (JP) ..... 2019-157257
Jul. 10, 2020 (JP) ..... 2020-119170

(51) Int. Cl.
*H01F 41/02* (2006.01)
*H01F 1/053* (2006.01)

(52) U.S. Cl.
CPC ..... *H01F 41/026* (2013.01); *H01F 1/053* (2013.01); *H01F 41/0293* (2013.01)

(58) Field of Classification Search
None
See application file for complete search history.

(56) References Cited

U.S. PATENT DOCUMENTS 4,765,848 A * 8/1988 Mohri ..... H01F 1/0577 420/83
2005/0268989 A1* 12/2005 Tomizawa ..... C22C 33/0278 148/105
2018/0182519 A1* 6/2018 Ito ..... H01F 1/0577

FOREIGN PATENT DOCUMENTS

CN 109979699 A 7/2019
EP 3 522 178 A1 8/2019

OTHER PUBLICATIONS

Lin (Journal of Magnetism and Magnetic Materials, vol. 490, 2019, No. 165454, Published on Jun. 12, 2019). (Year: 2019).*

(Continued)

*Primary Examiner* — Xiaowei Su
(74) *Attorney, Agent, or Firm* — Oliff PLC

(57) ABSTRACT

A rare earth magnet including a magnetic phase having the composition represented by $(Nd_{(1-x-y)}La_xCe_y)_2(Fe_{(1-z)}Co_z)_{14}B$. When the saturation magnetization at absolute zero and the Curie temperature calculated by Kuzmin's formula based on the measured values at finite temperature and the saturation magnetization at absolute zero and the Curie temperature calculated by first principles calculation are respectively subjected to data assimilation. The saturation magnetization M(x, y, z, T=0) at absolute zero and the Curie temperature obtained by machine learning using the assimilated data group are applied again to Kuzmin's formula and the saturation magnetization at finite temperature is represented by a function M(x, y, z, T), x, y, and z of the formula in an atomic ratio are in a range of satisfying M(x, y, z, T)>M(x, y, z=0, T) and 400≤T≤453.

2 Claims, 6 Drawing Sheets

(56) References Cited

OTHER PUBLICATIONS

Wecker (Applied Physics Letters, vol. 51, 1987, p. 697-699). (Year: 1987).*
Eric J. Skoug, et al., "Crystal structure and magnetic properties of Ce2Fe14—xCoxB alloys", Journal of Alloys and Compounds, vol. 574, (2013), pp. 552-555.
Takashi Miyake, et al., "First-Principles Study of Magnetocrystalline Anisotropy and Magnetization in NdFe12, NdFe11Ti, and NdFe11TiN", Journal of the Physical Society of Japan, vol. 83, (2014), pp. 043702-1-043702-4.

* cited by examiner

○ EXAMPLE (DATA ASSIMILATION)
● EXAMPLE (MEASURED VALUE)
△ COMPARATIVE EXAMPLE (DATA ASSIMILATION)
▲ COMPARATIVE EXAMPLE (MEASURED VALUE)

RARE EARTH MAGNETS

TECHNICAL FIELD

The present disclosure relates to rare earth magnets. The present disclosure particularly relates to a single-phase magnetic phase having an $R_2Fe_{14}B$ type (R is a rare earth element) crystal structure.

BACKGROUND ART

Of rare earth magnets, rare earth magnets including a magnetic phase having an $R_2Fe_{14}B$ type crystal structure have been known as high-performance permanent magnets. However, in recent years, there has been an increasing demand for improving the performance of permanent magnets, especially for further improving the saturation magnetization at high temperature.

It is commonly believed that there is a close relationship between the saturation magnetization at high temperature and the Curie temperature. Therefore, in order to improve the saturation magnetization at high temperature, an attempt has been made to raise the Curie temperature by substituting part of Fe with Co in a rare earth magnet including a magnetic phase having an $R_2Fe_{14}B$ type crystal structure. However, there are also reports that the stability of the $R_2Fe_{14}B$ type crystal structure is impaired by substituting part of Fe with Co.

For example, Non Patent Literature 1 discloses that, in a magnetic phase having an $R_2Fe_{14}B$ type crystal structure, substantially only Ce is selected as R, and the stability of the crystal structure of the magnetic phase is impaired when part of Fe is substituted with Co.

CITATION LIST

Non-Patent Literature

[NPL 1] Eric J. Skoug et al., "Crystal structure and magnetic properties of $Ce_2Fe_{14-x}Co_xB$ alloys" Journal of Alloys and Compounds 574 (2013) 552-555.

SUMMARY OF THE INVENTION

Problems to be Solved by the Invention

Since it is easy to obtain excellent magnetic properties in a rare earth magnet including a magnetic phase having an $R_2Fe_{14}B$ type crystal structure, substantially only Nd is often selected as R. Therefore, the amount of Nd used is increasing all over the world and the price of Nd is rising. Therefore, an attempt has been made to substitute part of Nd with inexpensive Ce. However, as disclosed in Eric J. Skoug et al., "Crystal structure and magnetic properties of $Ce_2Fe_{14-x}Co_xB$ alloys" Journal of Alloys and Compounds 574 (2013) 552-555, if Ce and Co coexists in the magnetic phase having an $R_2Fe_{14}B$ type crystal structure, the stability of the crystal structure of the magnetic phase may be impaired, leading to degradation of the saturation magnetization of the magnetic phase at high temperature.

Commonly, in the magnetic phase having an $R_2Fe_{14}$ type crystal structure, when substantially only Fe is selected as an iron group element and Nd is selected as R, and part of Nd is substituted with inexpensive Ce, the saturation magnetization of the magnetic phase is degraded at both room temperature and high temperature due to the substitution. Therefore, part of Nd is often substituted with Ce as long as the degradation of the saturation magnetization is acceptable. Unless otherwise specified herein, "high temperature" means a temperature in a range of 400 to 453 K.

Meanwhile, like the magnetic phase having an $R_2Fe_{14}$ type crystal structure disclosed in Eric J. Skoug et al., "Crystal structure and magnetic properties of $Ce_2Fe_{14-x}Co_xB$ alloys" Journal of Alloys and Compounds 574 (2013) 552-555, when substantially only Ce is selected as R and Fe is selected as an iron group element, and part of Fe is substituted with Co, the saturation magnetization of the magnetic phase is degraded at high temperature due to the substitution. Therefore, in the magnetic phase having an $R_2Fe_{14}$ type crystal structure, when part of Nd is substituted with Ce and part of Fe is substituted with Co, the saturation magnetization at high temperature is more degraded due to the substitution of them compared with the case where degradation is caused by the substitution of part of Nd with Ce. This means that, even when part of Fe is substituted with Co, which is more expensive than Fe, the substitution of part of Nd with Ce not only makes it impossible to improve the saturation magnetization at high temperature, but also causes degradation of the saturation magnetization at high temperature.

Thus, the present inventors have found a problem that there is required a rare earth magnet capable of enjoying an improvement in saturation magnetization at high temperature by substituting part of Fe with Co even when part of Nd is substituted with Ce in a rare earth magnet including a magnetic phase having an $R_2Fe_{14}B$ type crystal structure.

The rare earth magnet of the present disclosure have been made to solve the above problem. More specifically, an object of the present disclosure to provide a rare earth magnet capable of enjoying an improvement in saturation magnetization at high temperature by substituting part of Fe with Co even when part of Nd is substituted with Ce in a rare earth magnet including a magnetic phase having an $R_2Fe_{14}B$ type crystal structure.

Means to Solve the Problems

The present inventors have intensively studied so as to achieve the above object and accomplished the rare earth magnet of the present disclosure. The rare earth magnet of the present disclosure includes the following embodiments.

<1>A rare earth magnet including a single-phase magnetic phase having the composition represented by the formula $(Nd_{(1-x-y)}La_xCe_y)_2(Fe_{(1-z)}Co_z)_{14}B$ in an atomic ratio, wherein x, y, and z in the formula in an atomic ratio satisfy a relationship represented by the following formulas (1) to (3), and a material parameter s of the following formula (1) satisfies 0.50 to 0.70, and wherein x, y, and z in the formula in an atomic ratio are in a range of satisfying: $M(x, y, z, T)>M(x, y, z=0, T)$ and $400\leq T\leq 453$.

$$\mu_0 M(x, y, z, T) = \mu_0 M(x, y, z, T=0) \left[1 - s\left(\frac{T}{T_c(x, y, z)}\right)^{\frac{3}{2}} - (1-s)\left(\frac{T}{T_c(x, y, z)}\right)^{\frac{5}{2}}\right]^{\frac{1}{3}} \quad \text{Formula (1)}$$

$\mu_0$: vacuum permeability ($N/A^2$)

M(x,y,z,T): saturation magnetization at finite temperature (T)

M(x,y,z,T=0): saturation magnetization at absolute zero (T)

s: material parameter (–)

T: finite temperature (K)

$T_c$: Curie temperature (K)

$$\mu_0 M(x,y,z,T=0)=1.799-0.411x-0.451y-0.593z-0.011x^2+0.002y^2-0.070z^2-0.002xy-0.058yz-0.040zx \quad \text{Formula (2)}$$

$\mu_0$:vacuum permeability ($N/A^2$)

M(x,y,z,T=0):saturation magnetization at absolute: zero (T)

$$T_c(x,y,z)=588.894-5.825x-135.713y+506.799z+1.423x^2+10.016y^2-69.174z^2+125.862xy+15.110yz-12.342zx \quad \text{Formula (3)}$$

<2> The rare earth magnet according to item <1>, wherein the material parameter s satisfies 0.58 to 0.62.

<3> The rare earth magnet according to item <1>, wherein the material parameter s satisfies 0.60.

<4> The rare earth magnet according to any one of items <1> to <3>, wherein x, y, and z in the formula in an atomic ratio are in a range of satisfying M(x, y, z, T)>M(x, y, z=0, T) and T=453.

<5> The rare earth magnet according to any one of items <1> to <4>, wherein x, y, and z in the formula in an atomic ratio satisfy $0.03 \le x \le 0.50$, $0.03 \le y \le 0.50$, and $0.05 \le z \le 0.40$, respectively.

<6> The rare earth magnet according to item <1>, wherein the material parameter s is 0.60, and the value represented by M(x, y, z, T=453)–M(x, y, z=0, T=453) is 0.02 to 0.24.

<7> The rare earth magnet according to any one of items <1> to <6>, wherein a volume fraction of the magnetic phase is 90.0 to 99.0% relative to the entire rare earth magnet.

Effects of the Invention

According to the rare earth magnet of the present disclosure, it is possible to properly expand a crystal structure of a magnetic phase excessively reduced by the coexistence of Ce and Co by La having a large atomic radius after setting the contents of Nd, La, Ce, and Co in a predetermined range. As a result, it is possible to provide a rare earth magnet capable of enjoying an improvement in saturation magnetization at high temperature by substituting part of Fe with Co even when part of Nd is substituted with Ce. The reason why the magnetic phase of the rare earth magnet of the present disclosure is a single phase is that first principles calculation is used to determine the contents of Nd, La, Ce, and Co. Details will be described below.

MODE FOR CARRYING OUT THE INVENTION

Figure 1:
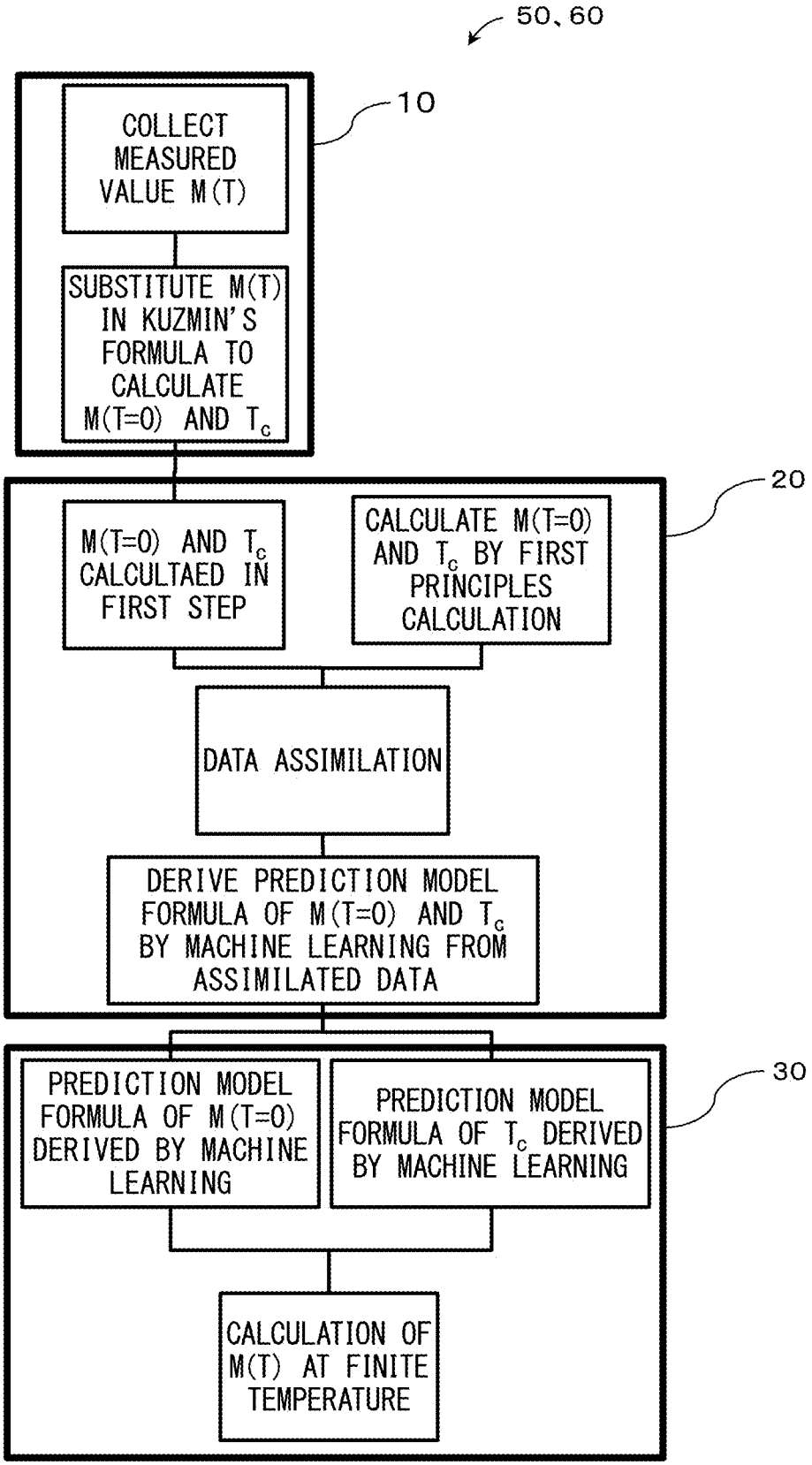
FIG. 1 is a flowchart showing a saturation magnetization prediction method.

Embodiments of the rare earth magnet of the present disclosure will be described in detail below. The embodiments shown below do not limit the rare earth magnet of the present disclosure.

As mentioned above, if Nd, Ce, and Co coexist in the magnetic phase having an $R_2Fe_{14}B$ type crystal structure, the stability of the crystal structure of the magnetic phase may be impaired, leading to degradation of the saturation magnetization at high temperature.

When the lattice constant of magnetic compounds with the compositions shown in Table 1 is determined using X-ray diffraction (XRD), it is possible to confirm that the crystal constant decreases, leading to reduction of the crystal structure, when part of Nd in $Nd_2Fe_{14}B$ is substituted with Ce or part of Fe is substituted with Co. Meanwhile, it is possible to confirm that the crystal constant increases, leading to expansion of the crystal structure, when part of Nd in $Nd_2Fe_{14}B$ is substituted with La.

TABLE 1

| | Contents of substitution elements | | | Lattice constants | | |
|---|---|---|---|---|---|---|
| | La | Ce | Co | | | |
| Magnetic compounds | content x | content y | content z | a | c | c/a |
| $Nd_2Fe_{14}B$ | 0 | 0 | 0 | 8.81 | 12.21 | 1.39 |
| $Nd_2(Fe_{0.6}Co_{0.4})_{14}B$ | 0 | 0 | 0.4 | 8.74 | 12.11 | 1.39 |
| $(Nd_{0.5}Ce_{0.5})_2Fe_{14}B$ | 0 | 0.5 | 0 | 8.78 | 12.17 | 1.39 |
| $(Nd_{0.5}La_{0.5})_2Fe_{14}B$ | 0.5 | 0 | 0 | 8.82 | 12.29 | 1.39 |

While not intending to be bound by theory, the present inventors have found the following.

Ce has a smaller atomic radius than that of Nd, and Co has a smaller atomic radius than that of Fe. Therefore, in the magnetic phase having an $R_2Fe_{14}B$ type crystal structure, if the total content of Ce and Co excessively increases, the interatomic distance in the crystal becomes excessively close, thus making it difficult to maintain the $R_2Fe_{14}B$ type crystal structure, especially at high temperature. As a result, it becomes difficult to enjoy an improvement in saturation magnetization at high temperature even when including expensive Co.

When the interatomic distance in the crystal is excessively close, if part of Nd in the magnetic phase is further substituted with La having a larger atomic radius than that of Nd, the substitution contributes to the stability of the $R_2Fe_{14}B$ type crystal structure. As a result, it is possible to restore the improvement in saturation magnetization at high temperature due to including Co. La is less expensive than Nd, which is favorable.

However, if the content of La in the magnetic phase is excessive, the large atomic radius of La may destroy the crystal structure, thus making the $R_2Fe_{14}B$ type crystal structure unstable, leading to impairment of an improvement in saturation magnetization at high temperature by including Co.

The present inventors have found from these results that it is possible to enjoy an improvement in saturation magnetization at high temperature due to Co by La even when part of Nd is substituted with Ce, by setting the contents of Nd, La, Ce, and Co in predetermined ranges.

Constituent features of the rare earth magnet of the present disclosure based on the above findings will be described below.

<<Rare Earth Magnet>>

The rare earth magnet of the present disclosure includes a magnetic phase having an $R_2Fe_{14}B$ type crystal structure. The magnetic phase of the rare earth magnet of the present disclosure will be described below.

<Magnetic Phase>

The rare earth magnet of the present disclosure includes a single-phase magnetic phase. The single phase means that elements constituting the magnetic phase are substantially uniformly distributed to form an $R_2Fe_{14}B$ type crystal structure. For example, when rare earth elements in the magnetic phase are subjected to plane analysis using scanning transmission electron microscope-energy dispersive X-ray spectrometry (STEM-EDX), the single-phase magnetic phase can be recognized as a single region. Meanwhile, the magnetic phase which is not a single phase can be recognized as multiple regions. The magnetic phase which is not a single phase includes, for example, a magnetic phase having a core/shell structure.

Since the rare earth magnet of the present disclosure includes a single-phase magnetic phase, it is possible to use first principles calculation when the contents of elements constituting the magnetic phase is determined.

The magnetic phase of the rare earth magnet of the present disclosure has the composition represented by the formula $(Nd_{(1-x-y)}La_xCe_y)_2(Fe_{(1-z)}Co_z)_{14}B$ in an atomic ratio. Nd is neodymium, La is lanthanum, Ce is cerium, Fe is iron, Co is cobalt, and B is boron. These elements will be described below.

<Nd>

Nd is an essential element for the magnetic phase of the rare earth magnet of the present disclosure. The magnetic phase exhibits high saturation magnetization at room temperature and high temperature due to Nd. The magnetic phase has high anisotropic magnetic field at room temperature.

<Ce>

Ce is an essential element for the magnetic phase of the rare earth magnet of the present disclosure. Part of Nd in the magnetic phase is substituted with Ce. Ce has a smaller atomic radius than that of Nd. Therefore, Ce reduces a crystal structure of the magnetic phase in size. Ce can be trivalent or tetravalent. In the first principles calculation mentioned below, Ce is treated as tetravalent. However, since data are assimilated with the measured values in which trivalence and tetravalence coexist and the material parameter s in Kuzmin's formula is the value considering the fact that trivalent and tetravalent Ce coexist, proper complementation is performed when a range of the content of Ce is determined.

<La>

La is an essential element for the magnetic phase of the rare earth magnet of the present disclosure. Part of Nd in the magnetic phase is substituted with La. La having a larger atomic radius than that of Nd mitigates excessive reduction in crystal structure of the magnetic phase due to the coexistence of Ce and Co in the magnetic phase.

<Fe>

Fe is an essential element for the magnetic phase of the rare earth magnet of the present disclosure. Fe constitutes the magnetic phase together with other elements, and the magnetic phase exhibits high saturation magnetization.

<Co>

Co is an essential element for the magnetic phase of the rare earth magnet of the present disclosure. Part of Fe in the magnetic phase is substituted with Co, and according to the Slater-Pauling rule, spontaneous magnetization increases, leading to an improvement in anisotropic magnetic field and saturation magnetization of the magnetic phase. Part of Fe in the magnetic phase is substituted with Co and the Curie point of the magnetic phase increases, leading to an improvement in saturation magnetization of the magnetic phase at high temperature.

<B>

B is an essential element for the magnetic phase of the rare earth magnet of the present disclosure, and B constitutes the magnetic phase together with other elements, and the magnetic phase exhibits high saturation magnetization.

In addition to these elements, the magnetic phase of the rare earth magnet of the present disclosure may include trace amounts of inevitable impurity elements. Inevitable impurity elements refer to impurity elements included in raw materials of the rare earth magnet, or impurity elements which are mixed during the production process, i.e., impurity elements whose inclusion is inevitable or impurity elements which cause significant increase in production costs so as to avoid the inclusion thereof. Impurities which are inevitably mixed during the production process include elements to be included without affecting magnetic properties, according to convenience for production. The inevitable impurity elements do not substantially exert an adverse influence on the magnetic properties of the rare earth magnet of the present disclosure, and therefore do not affect the calculated values, such as first principles calculation mentioned below.

<Contents x, y, and z of Elements Constituting Magnetic Phase> x, y, and z in the formula $(Nd_{(1-x-y)}La_xCe_y)_2(Fe_{(1-z)}Co_z)_{14}B$ in an atomic ratio satisfy the following formulas (1) to (3).

$$\mu_0 M(x, y, z, T) = \mu_0 M(x, y, z, T = 0)\left[1 - s\left(\frac{T}{T_c(x, y, z)}\right)^{\frac{3}{2}} - (1 - s)\left(\frac{T}{T_c(x, y, z)}\right)^{\frac{5}{2}}\right]^{\frac{1}{3}} \quad \text{Formula (1)}$$

$\mu_0$: vacuum permeability ($N/A^2$)

M(x,y, z, T): saturation magnetization at finite temperature (T)

M(x,y,z,T=0): saturation magnetization at absolute zero (T)

s: material parameter (–)

T: finite temperature (K)

$T_c$: Curie temperature (K)

$$\mu_0 M(x,y,z,T=0)=1.799-0.411x-0.451y-0.593z-0.011x^2+0.002y^2-0.070z^2-0.002xy-0.058yz-0.040zx \quad \text{Formula (2)}$$

$\mu_0$: vacuum permeability ($N/A^2$)

M(x,y,z,T=0): saturation magnetization at absolute zero (T)

$$T_c(x,y,z)=588.894-5.825x-135.713y+506.799z+1.423x^2+10.016y^2-69.174z^2+125.862xy+15.110yz-12.342zx \quad \text{Formula (3)}$$

The above formula (1) is Kuzmin's formula in which the saturation magnetization at finite temperature is represented by the saturation magnetization at absolute zero and the Curie temperature for the magnetic phase. The finite temperature is the absolute temperature other than absolute zero. The above formulas (2) and (3) are those in which the saturation magnetization at absolute zero and the Curie temperature calculated from Kuzmin's formula and the saturation magnetization at absolute zero and the Curie temperature calculated by first principles calculation are respectively subjected to data assimilation, and then the formulas are represented by a function obtained by machine learning of the data group. Details of the above formulas (2) and (3) will be described in "<<Saturation Magnetization Prediction Method>>" mentioned below.

By substituting the above formulas (2) and (3) into the formula (1) again, the saturation magnetization at finite temperature T (absolute temperature T other than absolute zero) is represented by a function M(x, y, z, T) of x, y, z, and T. In other words, the saturation magnetization of the magnetic phase of the rare earth magnet of the present disclosure is represented by a function of the composition of the magnetic phase and the finite temperature (absolute temperature other than absolute zero).

The material parameter s in the formula (1) is a dimensionless constant which is empirically known for the magnetic phase. Since the magnetic phase of the rare earth magnet of the present disclosure has an $R_2(Fe, Co)_{14}B$ type crystal structure, the material parameter s is 0.50 to 0.70. The material parameter s may be 0.52 or more, 0.54 or more, 0.56 or more, or 0.58 or more, or may be 0.68 or less, 0.66 or less, 0.64 or less, or 0.62 or less The material parameter s may also be 0.60. In the formula (1), $\mu_0$ to is the vacuum permeability, and $\mu_0$ to is $1.26\times10^{-6}$ $NA^{-2}$ in the unit system represented by the formula (1).

In the magnetic phase of the rare earth magnet of the present disclosure, x, y, and z are in a range of satisfying M(x, y, z, T)>M(x, y, z=0, T) and 400≤T≤453. As mentioned above, M(x, y, z, T) is that in which the saturation magnetization at finite temperature is represented by a function of the composition (x, y, and z) and the finite temperature (T) for the magnetic phase of the rare earth magnet of the present disclosure. Meanwhile, M(x, y, z=0, T) is that in which the saturation magnetization at finite temperature is represented by a function of the composition (x, y, z=0) and the finite temperature (T) for the magnetic phase of a Co-free (z=0) rare earth magnet.

The rare earth magnet of the present disclosure is capable of enjoying an improvement in saturation magnetization at high temperature by substituting part of Fe with Co even when part of Nd is substituted with Ce in a rare earth magnet including a magnetic phase having an $R_2Fe_{14}B$ type crystal structure. When all iron group elements are Fe (part of Fe is not substituted with Co) in a rare earth magnet including a magnetic phase having an $R_2Fe_{14}B$ type crystal structure, the saturation magnetization is degraded at both room temperature and high temperature if part of Nd is substituted with light rare earth elements such as Ce and La. The rare earth magnet of the present disclosure allows part of Nd to be substituted with light rare earth elements such as Ce and La leading to degradation of the saturation magnetization at both room temperature and high temperature, and enjoys an improvement in saturation magnetization at high temperature by including expensive Co. Therefore, if each of the La content x and the Ce content y is the value other than 0, the saturation magnetization of the magnetic phase of the rare earth magnet of the present disclosure increases when Co is included (z is other than 0) compared with the case where Co is not included. Therefore, x, y, and z satisfy: M(x, y, z, T)>M(x, y, z=0, T).

If M(x, y, z, T)−M(x, y, z=0, T) is defined and is regarded as "gain", x, y, and z of the magnetic phase of the rare earth magnet of the present disclosure satisfy that the gain (gain is more than 0 T (Tesla)) is present. The gain may be 0.01 T or more, 0.02 T or more, or 0.03 T or more. The higher the upper limit of the gain, the better. Substantially, the gain may be 0.50 T or less, 0.40 T or less, 0.30 T or less, or 0.24 T or less.

Since the gain is obtained at high temperature in the magnetic phase of the rare earth magnet of the present disclosure, finite temperature T (K: kelvin) satisfies 400≤T≤453. T may be 410 K or higher, 420 K or higher, 430 K or higher, 438 K or higher, 443 K or higher, or 448 K or higher. T may also be 453 K.

As mentioned above, x, y, and z are in a range of satisfying M(x, y, z, T)>M(x, y, z=0, T) at predetermined material parameter s and finite temperature T, and in addition to this, preferably may satisfy: 0.03≤x≤0.50, 0.03≤y≤0.50, and 0.05≤z≤0.40. For example, if 0.03≤x≤0.50, 0.03≤y≤0.50, and 0.05≤z≤0.40 are satisfied at a predetermined material parameter s (s=0.6) and a specific finite temperature (T=453 K), all of specific gain ranges of 0.02 T to 0.24 T are satisfied. At this time, the composition of the rare earth magnet of the present disclosure is represented only by the above-mentioned ranges of x, y, and z. In other words, the composition of the rare earth magnet of the present disclosure is represented by the rectangular region represented by 0.03≤x≤0.50, 0.03≤y≤0.50, and 0.05≤z≤0.40 in an orthogonal coordinate system of x, y, and z. x, y, and z of the composition of the rare earth magnet of the present disclosure may be in the following ranges. x may be 0.03 or more, 0.10 or more, 0.15 or more, 0.20 or more, or 0.25 or more, or may be 0.50 or less, 0.45 or less, 0.40 or less, or 0.35 or less. y may be 0.03 or more, 0.10 or more, 0.15 or more, 0.20 or more, or 0.25 or more, or may be 0.50 or less, 0.45 or less, 0.40 or less, or 0.35 or less. z may be 0.05 or more, 0.10 or more, 0.15 or more, or 0.20 or more, or may be 0.40 or less, 0.35 or less, or 0.30 or less.

<Volume Fraction of Magnetic Phase>

Figure 3:
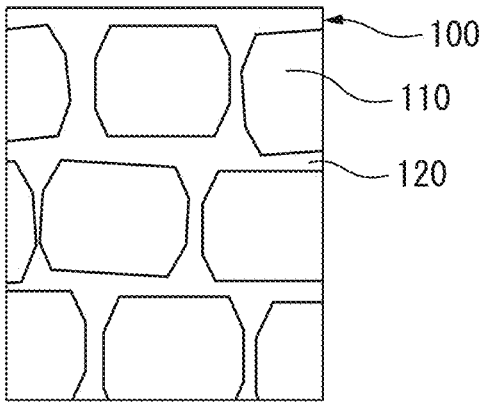
FIG. 3 is an explanatory diagram showing a typical example of the metal structure of the rare earth magnet of the present disclosure.

The structure of the rare earth magnet of the present disclosure will be described with reference to the drawings. FIG. 3 is an explanatory diagram showing a typical example of the metal structure of the rare earth magnet of the present disclosure. The rare earth magnet 100 of the present disclosure includes a magnetic phase 110. The rare earth magnet 100 of the present disclosure may include, but are not limited to, a grain boundary phase 120.

The magnetic phase 110 has an $R_2Fe_{14}B$ type crystal structure. The magnetic phase 110 is a single phase. The "single phase" is as mentioned above.

The rare earth magnet 100 of the present disclosure may be entirely composed of the magnetic phase 110, and the volume fraction of the magnetic phase 110 is typically 90.0 to 99.0% relative to the entire rare earth magnet 100 of the present disclosure. The volume fraction of the magnetic phase 110 may be 90.5% or more, 91.0% or more, 92.0% or more, 93.0% or more, 94.0% or more, 94.5% or more, or 95.0% or more, or may be 98.5% or less, 98.0% or less, 97.5% or less, 97.0% or less, 96.5% or less, or 96.0% or less.

In the rare earth magnet 100 of the present disclosure, when the volume fraction of the magnetic phase 110 is not 100%, the remaining balance is typically a grain boundary phase 120. When the rare earth magnet 100 of the present disclosure includes the grain boundary phase 120, x, y, and z are nearly identical in each of the magnetic phase 110, the grain boundary phase 120, and the entire rare earth magnet 100 of the present disclosure. Meanwhile, the total content of rare earth elements (total content of Nd, La, and Ce) in the grain boundary phase 120 is more than that in the magnetic phase 110. Therefore, the grain boundary phase is called a rare earth element-rich phase or an R-rich phase in the rare earth magnet including a magnetic phase having an $R_2Fe_{14}B$ type crystal structure.

If the volume fraction of the magnetic phase 110 of the rare earth magnet 100 of the present disclosure is 100%, the entire composition of the rare earth magnet 100 of the present disclosure (total of magnetic phase 110 and grain boundary phase 120) is represented by the formula $(Nd_{(1-x-y)}La_xCe_y)_p(Fe_{(1-z)}Co_z)_{(100-p-q)}B_q$ (where p=11.76, q=5.88, and 100−p−q=82.36) in an atomic ratio. When including an inevitable impurity element M, the entire composition of the rare earth magnet 100 of the present disclosure is represented by the formula $(Nd_{(1-x-y)}La_xCe_y)_p(Fe_{(1-z)}Co_z)_{(100-p-q-r)}B_qM_r$ (where p=11.76, q=5.88, 100−p−q−r=82.36, and r=0 to 1.0) in an atomic ratio. However, the amount of inevitable impurities existing in the magnetic phase 110 is an extremely small amount, and when relatively large amount of inevitable impurities exist, most of the inevitable impurities exist in the grain boundary phase 120 (volume fraction of the magnetic phase is not 100%).

When the rare earth magnet 100 of the present disclosure includes the grain boundary phase 120, as mentioned above, the total content of rare earth elements (total content of Nd, La, and Ce) in the grain boundary phase 120 is more than that in the magnetic phase 110. Therefore, when the volume fraction of the magnetic phase 110 of the rare earth magnet 100 of the present disclosure is not 100%, the entire composition of the rare earth magnet 100 of the present disclosure (total content of magnetic phase 110 and grain boundary phase 120) is represented by the formula $(Nd_{(1-x-y)}La_xCe_y)_p(Fe_{(1-z)}Co_z)_{(100-p-q)}B_q$ (where p=12 to 20, q=5 to 8, and p+q+(100−p−q)=100) in an atomic ratio. When including an inevitable impurity element M, the entire composition of the rare earth magnet 100 of the present disclosure is represented by the formula $(Nd_{(1-x-y)}La_xCe_y)_p(Fe_{(1-z)}Co_z)_{(100-p-q-r)}B_qM_r$ (where p=12 to 20, q=5 to 8, r=0 to 1.0, and p+q+r+(100−p−q−r)=100) in an atomic ratio. As mentioned above, it is believed that most of the inevitable impurities exist in the grain boundary phase 120.

In the magnetic material, the size of the magnetic phase in the magnetic material does not affect the magnitude of the saturation magnetization of the magnetic phase. Therefore, in the rare earth magnet 100 of the present disclosure, the saturation magnetization of the magnetic phase 110 is represented by a function of the composition (x, y, and z) and the finite temperature (T).

Meanwhile, the saturation magnetization of the rare earth magnet 100 of the present disclosure and the saturation magnetization of the magnetic phase 110 of the rare earth magnet 100 of the present disclosure have the following relationship. The saturation magnetization of rare earth magnet 100 of the present disclosure={saturation magnetization M(x, y, z, T) of magnetic phase 110 of rare earth magnet of the present disclosure}/{(volume fraction % of magnetic phase 110 of rare earth magnet 100 of the present disclosure)/100}.

<<Production Method>>

The method for producing a rare earth magnet of the present disclosure is not particularly limited as long as a single-phase magnetic phase having an $R_2Fe_{14}B$ type (R is rare earth element) crystal structure can be formed. Examples of such a production method include a method in which molten metal obtained by arc melting of raw materials of the rare earth magnet of the present disclosure is solidified, a mold casting method, a rapid solidification method (strip casting method), and an ultra-rapid solidification method (liquid quenching method). Ultra-rapid cooling means cooling the molten metal at a rate of $1\times10^2$ to $1\times10^7$ K/sec. An ingot or a thin strip obtained by such a method may be subjected to a homogenization heat treatment in an inert gas atmosphere at 973 to 1,573 K for 1 to 100 hours. By the homogenization heat treatment, constituent elements in the magnetic phase are more uniformly distributed. A single-phase magnetic phase having an $R_2Fe_{14}B$ type (R is a rare earth element) crystal structure may be obtained from a material including an amorphous phase by a heat treatment.

There is no particular limitation on the method for fabricating a bulk body. The ingot or thin strip obtained by the above method may be crushed into a magnetic powder, followed by binding of the magnetic powder with a resin binder to form a bonded magnet or sintering of the magnetic powder to form a sintered magnet. When the magnetic phase in the magnetic powder has a size of 1 to 500 μm, a pressureless sintering method can be used. When the magnetic phase in the magnetic powder has a size of 1 to 900 nm, a pressure sintering method can be used.

In both cases of forming the bonded magnet and the sintered magnet, anisotropy may be imparted to the rare earth magnet of the present disclosure. This is because the saturation magnetization is improved by imparting the anisotropy, but the fact remains that the saturation magnetization is a function of the composition and the temperature (if the composition and temperature are the same, the saturation magnetization is improved by the amount of the anisotropy imparted). There is no particular limitation on the method for imparting anisotropy. When the magnetic phase in the magnetic powder has a size of 1 to 500 μm, a magnetic field forming method may be used. The magnetic field forming method means that a bonded magnet is formed in a magnetic field, or a green compact is formed in a magnetic field before pressureless sintering. When the magnetic phase in the magnetic powder has a size of 1 to 900 nm, a hot plastic working method can be used. The hot plastic working method means a method in which a pressure-sintered body is subjected to hot plastic working at a compression rate of 10 to 70%.

As mentioned above, if the magnetic phase is a single phase, the saturation magnetization is determined regardless of the size of the magnetic phase, thus making it possible to select various production methods mentioned above.

<<Saturation Magnetization Prediction Method>>

The rare earth magnet of the present disclosure includes a single-phase magnetic phase having an $R_2Fe_{14}B$ type crystal structure. Therefore, it is possible to use a saturation magnetization prediction method described below (hereinafter sometimes referred to as "saturation magnetization prediction method of the present disclosure") for the determination of the composition of the magnetic phase. To gain a better understanding of the saturation magnetization prediction method of the present disclosure, first, a description is made of the case where the crystal structure of the magnetic phase is not specified, and then a description is made of the case where the magnetic phase has an $R_2Fe_{14}B$ type crystal structure. Since the saturation magnetization prediction method of the present disclosure uses first principles calculation, the magnetic phase is a single phase with or without specifying the crystal structure of the magnetic phase.

The saturation magnetization prediction method of the present disclosure will be described with reference to the drawings. FIG. 1 is a flowchart showing a method for predicting saturation magnetization of the present disclosure. The saturation magnetization prediction method 50 of the present disclosure comprises a first step 10, a second step 20, and a third step 30. Each step will be described below.

<First Step>

In the first step, measured data of saturation magnetization of the magnetic phase at finite temperature are substituted into Kuzmin's formula to calculate saturation magnetization at absolute zero and the Curie temperature for the magnetic phase. This step will be described in detail below.

Saturation magnetization M(T) at finite temperature T(K) of the magnetic phase is measured in advance. Then, the measured data thereof are substituted into Kuzmin's formula (1-1) to calculate saturation magnetization M(T=0) at absolute zero and the Curie temperature $T_c$ for the magnetic phase. The finite temperature means any absolute temperature other than absolute zero.

$$\mu_0 M(T) = \mu_0 M(T=0)\left[1 - s\left(\frac{T}{T_c}\right)^{\frac{3}{2}} - (1-s)\left(\frac{T}{T_c}\right)^{\frac{5}{2}}\right]^{\frac{1}{3}} \quad \text{Formula (1-1)}$$

$\mu_0$: vacuum permeability ($N/A^2$)

M(T): saturation magnetization at finite temperature (T)

M(T=0): saturation magnetization at absolute zero (T)

s: material parameter (–)

T: finite temperature (K)

$T_c$: Curie temperature (K)

Examples of the method for calculating saturation magnetization M(T=0) at absolute zero and the Curie temperature $T_c$ include the following methods. For the magnetic phase having a certain composition, the saturation magnetization M(T)s at plural finite temperatures T are measured in advance, and the saturation magnetization at absolute zero M(T=0) and the Curie temperature Tc are calculated for the magnetic phase with the composition by regression analysis. Using the same procedure, the saturation magnetization M(T=0) at absolute zero and the Curie temperature $T_c$ are preferably calculated for magnetic phases having plural compositions.

Well-known methods can be used as the regression analysis method. Examples of the regression analysis method include single regression analysis, multiple regression analysis, and least squares method, and these methods may be used in combination. Of these, the least squares method is particularly preferable.

In the magnetic phase, as the temperature rises from absolute zero, the saturation magnetization nonlinearly decreases and reaches 0 at the Curie temperature. It is known that a relationship between the temperature and the saturation magnetization can be approximated by Kuzmin's formula.

The material parameter s in Kuzmin's formula is a dimensionless constant which is empirically known for the magnetic phase.

As the magnetic phase of the rare earth magnet, for example, a magnetic phase having a $ThMn_{12}$ type crystal structure is known. The material parameter s of the magnetic phase having a $ThMn_{12}$ type crystal structure is 0.5 to 0.7.

As the magnetic phase of the rare earth magnet, for example, a magnetic phase having an $R_2(Fe, Co)_{14}B$ type (where R is a rare earth element) crystal structure is known. The material parameter s of the magnetic phase having an $R_2(Fe, Co)_{14}B$ type crystal structure is 0.50 to 0.70. The material parameter s of the magnetic phase having an $R_2(Fe, Co)_{14}B$ type crystal structure may be 0.52 or more, 0.54 or more, 0.56 or more, or 0.58 or more, or may be 0.68 or less, 0.66 or less, 0.64 or less, or 0.62 or less. The material parameter s of the magnetic phase having an $R_2(Fe, Co)_{14}B$ type crystal structure may be 0.60.

As the magnetic phase of the rare earth magnet, for example, a magnetic phase having a $Th_2Zn_{17}$ type crystal structure is known. The material parameter s of the magnetic phase having a $Th_2Zn_{17}$ type crystal structure is 0.5 to 0.7.

As the magnetic phase of a ferrite magnet, a magnetic phase having a spinel type crystal structure is known. The material parameter s of the magnetic phase having a spinel type crystal structure is 0.5 to 0.7.

In Kuzmin's formula, $\mu_0$ is the vacuum permeability, and $\mu_0$ is $1.26\times10^{-6}$ $NA^{-2}$ in the unit system represented by the formula (1-1).

The greater the number of actual data to be measured, the more accuracy of the saturation magnetization obtained by the saturation magnetization prediction method of the present disclosure is improved. However, as the number of data to be measured increases, man-hours for data collection increase. Therefore, the number of data to be measured may be determined appropriately in combination with the required prediction accuracy.

Samples for collecting the measured values can be prepared using a well-known method for producing a magnetic material. This is because, in the magnetic material, the size of the magnetic phase in the magnetic material does not affect the magnitude of the saturation magnetization of the magnetic phase. This is also because the magnetic material commonly includes phases other than the magnetic phase, and the saturation magnetization of the magnetic phase is determined by the following formula: (measured values of saturation magnetization in sample)/{(volume fraction (%) of magnetic phase in sample)/100}. The volume fraction (%) of the magnetic phase in the sample is the volume fraction (%) of the magnetic phase relative to the entire sample. In order to suppress compositional variation in the magnetic phase, it is preferable that raw materials of the magnetic material are arc-melted and solidified to obtain an ingot, which is subjected to a homogenization heat treatment and then used after crushing. Using a vibrating sample magnetometer (VSM), the M-H curve of the crushed magnetic powder is measured. Then, the saturation magnetization of the entire sample (all of the magnetic powder) is calculated from the M-H curve by the law of approach to saturation magnetization, and the calculated value is divided by {(magnetic phase volume fraction (%))/100} to obtain the value of the saturation magnetization of the magnetic phase.

<Second Step>

In the second step, the saturation magnetization at absolute zero and the Curie temperature of the magnetic phase calculated in the first step and the saturation magnetization at absolute zero and the Curie temperature of the magnetic phase calculated by first principles calculation are respectively subjected to data assimilation. For the saturation magnetization at absolute zero and the Curie temperature, the prediction model formula represented by a function of the existence ratios of elements constituting the magnetic phase is derived by machine learning. This step will be described in detail below.

By first principles calculation, the saturation magnetization at absolute zero M(T=0) and the Curie temperature $T_c$ of the magnetic phase are respectively calculated. In the first principles calculation, the exchange interaction between local magnetic moments is calculated and the Curie temperature $T_c$ can be obtained by applying the calculation results to the Heisenberg model. Then, the saturation magnetization at absolute zero M(T=0) and the Curie temperature $T_c$ of the magnetic phase calculated in the first step, and the saturation magnetization at absolute zero M(T=0) and the Curie temperature $T_c$ of the magnetic phase calculated by first principles calculation are respectively subjected to data assimilation. The data assimilation means that the difference between M(T=0) and $T_c$ (M(T=0) and $T_c$ calculated in the first step) based on the measured values and M(T=0) and $T_c$ (M(T=0) and $T_c$ calculated in the second step) based on numerical calculation is decreased using the statistical estimation theory. Examples of the method of data assimilation include an optimal interpolation method, a Kalman filter, a 3-dimensional variational method, and a 4-dimensional variational method, and these methods may be used in combination.

For the saturation magnetization at absolute zero and the Curie temperature, the prediction model formula represented by a function of the existence ratios of elements constituting the magnetic phase is derived by machine learning, based on the assimilated data M(T=0) and $T_c$ (data group by data assimilation).

Since first principles calculation is based on quantum mechanics, the saturation magnetization M(T=0) calculated by first principles calculation is represented by a function of the existence ratio (atomic ratio) of elements constituting the magnetic phase. Therefore, the saturation magnetization M(T=0) and the Curie temperature $T_c$ calculated in the first step and the saturation magnetization M(T=0) and the Curie temperature $T_c$ calculated by first principles calculation are respectively subjected to data assimilation. The prediction model formula derived by machine learning based on them is represented by a function of the existence ratios of elements constituting the magnetic phase.

Well-known techniques can be used as the technique for machine learning, and examples thereof include decision tree learning, correlation rules learning, neural network learning, regularization method, regression method, deep learning, induction theory programming, support vector machines, clustering, Bayesian network, reinforcement learning, representation learning, and extreme learning machine. These may be used in combination. Of these, techniques capable of being regressed in a nonlinear manner are particularly preferable.

General-purpose software can be used to perform machine learning, and examples thereof include R, Python, IBM (registered trademark), SPSS (registered trademark), Modeler, and MATLAB. Of these, R and Python are particularly preferable because of their high versatility.

<Third Step>

In the third step, the saturation magnetization at absolute zero and the Curie temperature of the magnetic phase created in the second step are each applied to the prediction model formula to Kuzmin's formula shown in formula (1-1) above to calculate the saturation magnetization at finite temperature in the magnetic phase. This step will be described in detail below.

Kuzmin's formula (1-1) mentioned above is the formula showing a relationship among the saturation magnetization at absolute zero M(T=0), the saturation magnetization M(T) at finite temperature, and the Curie temperature $T_c$ of the magnetic phase. Therefore, if the prediction model formula for the saturation magnetization at absolute zero and the Curie temperature is applied to the formula (1-1), it is possible to expand the prediction model formula of the saturation magnetization at absolute temperature to the prediction model formula of the saturation magnetization at finite temperature.

<Embodiment in Which Magnetic Phase Has (Nd, La, Ce)$_2$(Fe, Co)$_{14}$B Type Crystal Structure>

With respect to the above-mentioned saturation magnetization prediction method of the present disclosure, including the first step, the second step, and the third step, a description is made of the embodiment in which the magnetic phase has a (Nd, La, Ce)$_2$(Fe, Co)$_{14}$B type crystal structure.

<Composition of Magnetic Phase>

The composition of the magnetic phase having a (Nd, La, Ce)$_2$(Fe, Co)$_{14}$B type crystal structure can be represented by, for example, the formula $(Nd_{(1-x-y)}La_xCe_y)_2(Fe_{(1-z)}Co_z)_{14}B$ in an atomic ratio. x, y, and z satisfy: $0 \le x \le 1$, $0 \le y \le 1$, and $0 \le z \le 1$, respectively. x+y satisfies: $0 \le x+y \le 1$. x=0 means that the magnetic phase does not include La. x=1 means that the magnetic phase does not include Nd and Ce as rare earth elements, and includes only La. y=0 means that the magnetic phase does not include Ce. y=1 means that the magnetic phase does not include Nd and La as rare earth element, and includes only Ce. z=0 means that the magnetic phase does not include Co. z=1 means that the magnetic phase includes only Co as iron group elements, and does not include Fe.

Kuzmin's formula is represented by a function of x, y, and z as shown in the following formula (1-2). The material parameter s is 0.50 to 0.70. The material parameter s may be 0.52 or more, 0.54 or more, 0.56 or more, or 0.58 or more, or may be 0.68 or less, 0.66 or less, 0.64 or less, or 0.62 or less. The material parameter s may be 0.60. $\mu_0$ to is the vacuum permeability, and ILO is $1.26 \times 10^{-6}$ $NA^{-2}$ in the unit system represented by the formula (1-2).

$$\mu_0 M(x, y, z, T) = \mu_0 M(x, y, z, T=0)\left[1 - s\left(\frac{T}{T_c(x, y, z)}\right)^{\frac{3}{2}} - (1-s)\left(\frac{T}{T_c(x, y, z)}\right)^{\frac{5}{2}}\right]^{\frac{1}{3}} \quad \text{Formula (1-2)}$$

$\mu_0$: vacuum permeability ($N/A^2$)

M(x,y,z,T): saturation magnetization at finite temperature (T)

M(x,y,z, T=0): saturation magnetization at absolute zero (T)

s: material parameter (–)

T: finite temperature (K)

$T_c$: Curie temperature (K)

The saturation magnetization absolute temperature derived by machine learning is represented by a function M(x, y, z, T=0) of x, y, and z, as shown in the following formula (2). In other words, the saturation magnetization at absolute zero derived by machine learning is represented by a function of the existence ratios x, y, and z of elements constituting the magnetic phase. to is the vacuum permeability, and to is $1.26\times10^{-6}$ $NA^{-2}$ in the unit system represented by the formulas (1-2) and (2).

$$\mu_0 M(x,y,z,T=0)=1.799-0.411x-0.451y-0.593z-0.011x^2+0.002y^2-0.070z^2-0.002xy-0.058yz-0.040zx \quad \text{Formula (2)}$$

$\mu_0$: vacuum permeability($N/A^2$)

M(x,y,z T=0): saturation magnetization at absolute zero (T)

The Curie temperature derived by machine learning is represented by a function $T_c$(x, y, z) of x, y, and z, as shown in the following formula (3). In other words, the Curie temperature derived by machine learning is represented by a function of the existence ratios x, y, and z of elements constituting the magnetic phase.

$$T_c(x,y,z)=588.894-5.825x-135.713y+506.799z+1.423x^2+10.016y^2-69.174z^2+125.862xy+15.110yz-12.342zx \quad \text{Formula (3)}$$

Next, with respect to the case where the composition of the magnetic phase can be represented by $(Nd_{(1-x-y)}La_xCe_y)_2(Fe_{(1-z)}Co_z)_{14}B$, each of the first step, second step, and the third step will be described.

In the first step, for example, the measured values of saturation magnetization of the magnetic phase are substituted into the above formula (1-2) to calculate the saturation magnetization at absolute zero M(T=0) and the Curie temperature $T_c$ for the magnetic phase having the composition shown in Table 2.

Samples for measuring the saturation magnetization are not particularly limited as long as a single-phase magnetic phase having an $R_2Fe_{14}B$ type (R is a rare earth element) can be formed. Examples of such a production method include a method in which molten metal obtained by arc melting of raw materials of the rare earth magnet of the present disclosure is solidified, a mold casting method, a rapid solidification method (strip casting method), and an ultra-rapid solidification method (liquid quenching method). Ultra-rapid cooling means cooling the molten metal at a rate of $1\times10^2$ to $1\times10^7$ K/sec. An ingot or a thin strip obtained by such a method may be subjected to a homogenization heat treatment in an inert gas atmosphere at 973 to 1,573 K for 1 to 100 hours. By the homogenization heat treatment, constituent elements in the magnetic phase are more uniformly distributed. A single-phase magnetic phase having an $R_2Fe_{14}B$ type (R is a rare earth element) crystal structure may be obtained from a material including an amorphous phase by a heat treatment. The saturation magnetization of a magnetic powder obtained by crushing the ingot or thin strip thus obtained is measured using a vibrating sample magnetometer (VSM). In order to suppress the compositional variation in the magnetic phase, the above-mentioned homogenization heat treatment is preferably performed before and after crushing.

In order to suppress compositional variation in the magnetic phase, it is preferable that raw materials of the magnetic material are arc-melted and solidified to obtain an ingot, which is subjected to a homogenization heat treatment and then used after crushing. The homogenization heat treatment may be performed after crushing. Then, the saturation magnetization of a magnetic powder obtained by crushing is measured using a vibrating sample magnetometer (VSM).

TABLE 2

| | Contents of constituent elements | | | Measured values | | Values calculated from Kuzmin's formula | |
|---|---|---|---|---|---|---|---|
| | La content x | Ce content y | Co content z | Measurement temperature (K) | Saturation magnetization (T) | Curie temperature $T_c$ (K) | Saturation magnetization at absolute zero M(T = 0) (T) |
| Composition 1 | 0 | 0 | 0 | 300 | 1.61 | 567 | 1.91 |
| | | | | 348 | 1.53 | | |
| | | | | 373 | 1.48 | | |
| | | | | 453 | 1.27 | | |
| Composition 2 | 0.1 | 0 | 0.2 | 300 | 1.56 | 665 | 1.69 |
| | | | | 348 | 1.48 | | |
| | | | | 433 | 1.39 | | |
| | | | | 453 | 1.35 | | |
| Composition 3 | 0.1 | 0.2 | 0 | 300 | 1.31 | 575 | 1.47 |
| | | | | 348 | 1.24 | | |
| | | | | 433 | 1.09 | | |
| | | | | 473 | 0.99 | | |

In Table 2, the saturation magnetization at absolute zero M(T=0) and the Curie temperature $T_c$ are calculated from Kuzmin's formula for three types of the compositions, but are not limited thereto. When the saturation magnetization at absolute zero M(T=0) and the Curie temperature $T_c$ are calculated from Kuzmin's formula for as many different compositions as possible, the prediction accuracy of the saturation magnetization is improved. However, it requires many measured values of the saturation magnetization, leading to an increase in man-hours for data collection. Therefore, the number of types of compositions of the magnetic phase may be appropriately determined according to the balance between the prediction accuracy and the man-hours for data collection.

In Table 2, the saturation magnetization at absolute zero M(T=0) and the Curie temperature $T_c$ are calculated from Kuzmin's formula by regression from four measured values for one type of the composition, but are not limited thereto. When regression is performed using as many measured values as possible, the prediction accuracy of the saturation magnetization is improved. However, it requires many measured values of the saturation magnetization, leading to an increase in man-hours for data collection. Therefore, the number of measured values of the saturation magnetization may be appropriately determined with respect to one type of the composition of the magnetic phase according to the balance between the prediction accuracy and the man-hours for data collection.

In the second step, for example, the saturation magnetization at absolute temperature M(T=0) and the Curie temperature $T_c$ are calculated by first principles calculation for the magnetic phase having the compositions shown in Table 3. In Table 3, "–" means that the saturation magnetization at absolute temperature M(T=0) and the Curie temperature $T_c$ were not calculated by first principles calculation for the corresponding composition.

TABLE 3

| | Contents of constituent elements | | | Values calculated by first principles calculation | |
|---|---|---|---|---|---|
| | La content x | Ce content y | Co content z | Curie temperature $T_c$ (K) | Saturation magnetization at absolute zero M(T = 0) (T) |
| Composition 1 | 0 | 0 | 0 | 1,090 | 1.83 |
| Composition 2 | 0.1 | 0 | 0.2 | — | — |
| Composition 3 | 0.1 | 0.2 | 0 | — | — |
| Composition 4 | 0 | 0.1 | 0.2 | 1,064 | 1.69 |
| Composition 5 | 0.1 | 0.1 | 0.1 | 1,070 | 1.71 |
| Composition 6 | 0.2 | 0.2 | 0.3 | 1,034 | 1.52 |
| Composition 7 | 0.3 | 0.2 | 0.1 | 1,063 | 1.59 |
| . | . | . | . | . | . |
| . | . | . | . | . | . |
| . | . | . | . | . | . |

In the second step, the saturation magnetization at absolute temperature M(T=0) and the Curie temperature $T_c$ calculated in the first step and the saturation magnetization at absolute temperature M(T=0) and the Curie temperature $T_c$ calculated in the second step using first principles calculation are respectively subjected to data assimilation. In other words, M(T=0) and $T_c$ shown in Table 1 and M(T=0) shown in Table 3 are subjected to data assimilation. The results of data assimilation are shown in Table 4. In Table 4, "–" means that data were not assimilated for the corresponding composition.

[Table 4]

TABLE 4

| | Contents of constituent elements | | | Data group by data assimilation | |
|---|---|---|---|---|---|
| | La content x | Ce content y | Co content z | Curie temperature $T_c$ (K) | Saturation magnetization at absolute zero M(T = 0) (T) |
| Composition 1 | 0 | 0 | 0 | 589 | 1.80 |
| Composition 2 | 0.1 | 0 | 0.2 | — | — |
| Composition 3 | 0.1 | 0.2 | 0 | — | — |
| Composition 4 | 0 | 0.1 | 0.2 | 674 | 1.63 |
| Composition 5 | 0.1 | 0.1 | 0.1 | 626 | 1.65 |
| Composition 6 | 0.2 | 0.2 | 0.3 | 712 | 1.44 |
| Composition 7 | 0.3 | 0.2 | 0.1 | 609 | 1.48 |
| . | . | . | . | . | . |
| . | . | . | . | . | . |
| . | . | . | . | . | . |

In Table 4, M(T=0) and $T_c$ (M(T=(0) and $T_c$) other than the composition 1, the composition 2, and the composition 3 (M(T=(0) and $T_c$ of the subsequent compositions of the composition 4) are complementarily linked data by data assimilation. In Table 3, M(T=0) and $T_c$ of the composition 1 are data obtained by complementary modification of data calculated in the first step. M(T=0) and $T_c$ (data group by data assimilation) shown in Table 4 are data group obtained by assimilating data calculated from the measured values and data calculated by first principles calculation. Therefore, the data group obtained by data assimilation is more accurate than the data group obtained by only first principles calculation.

Furthermore, in the second step, using the assimilated data group, the saturation magnetization M(x, y, z, T=0) at absolute zero represented by a function of elements constituting the magnetic phase and $T_c$(x, y, z, T=0) are derived by machine learning. M(x, y, z, T=0) and $T_c$(x, y, z, T=0) are specifically represented by the above formulas (2) and (3).

Figure 2A:
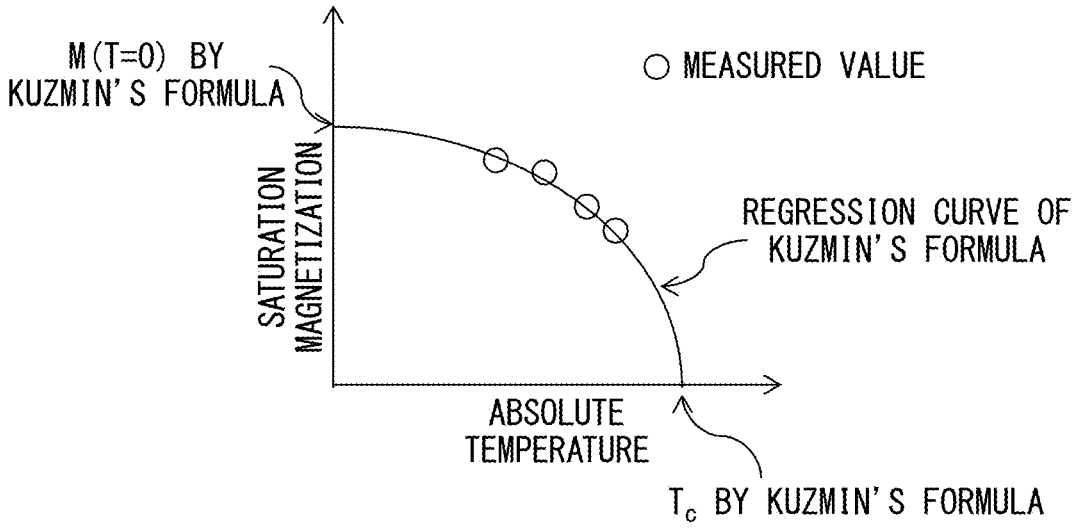
FIG. 2A is a graph showing a relationship between the absolute temperature and the saturation magnetization for a magnetic phase having the composition 1 in Table 2.
Figure 2B:
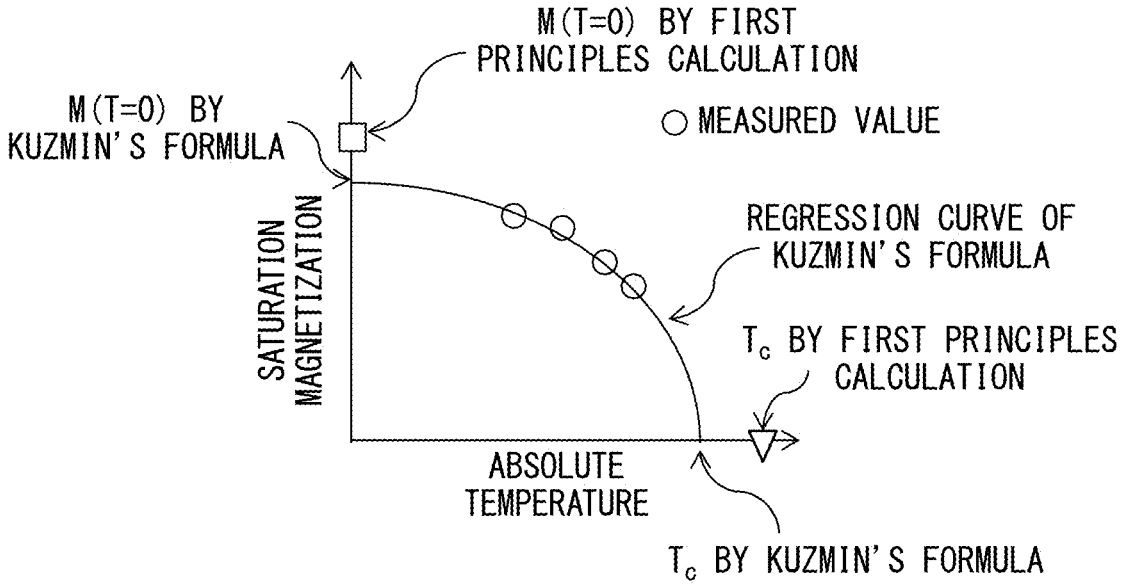
FIG. 2B is a graph in which M(T=0) and $T_c$ calculated by first principles calculation are added to the graph shown in FIG. 2A.
Figure 2C:
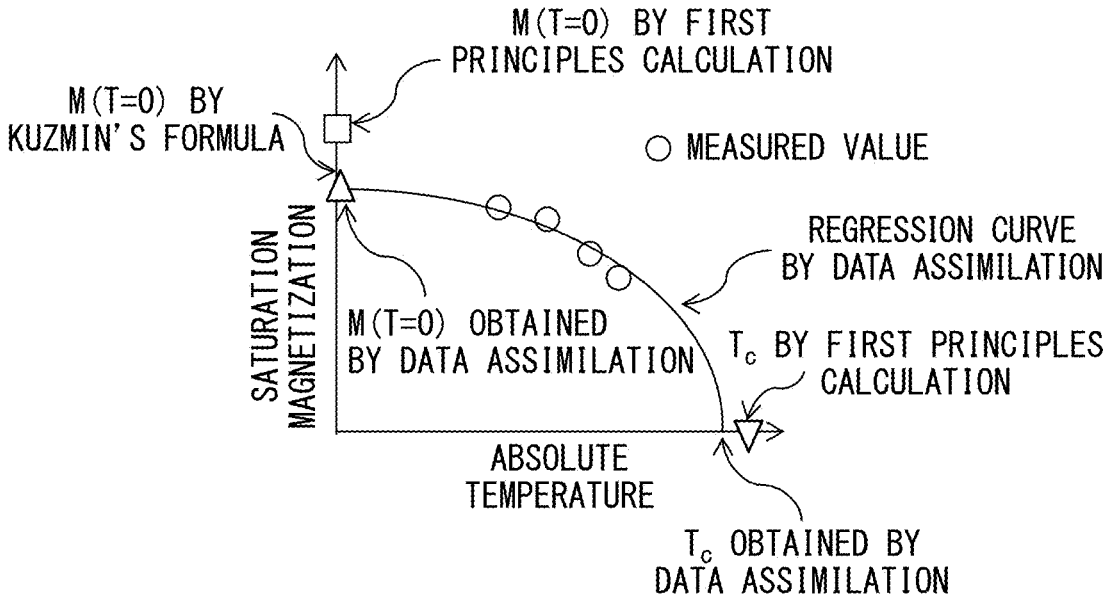
FIG. 2C is a graph in which M(T=0) and $T_c$ obtained by data assimilation are added to the graph shown in FIG. 2B.

Tables 2 to 4 will be further described with reference to the drawings. FIG. 2A is a graph showing a relationship between the absolute temperature and the saturation magnetization for the magnetic phase with the composition 1 in Table 2. FIG. 2B is a graph in which M(T=0) and $T_c$ calculated by first principles calculation are added to the graph shown in FIG. 2A. FIG. 2C is a graph in which M(T=0) and $T_c$ obtained by data assimilation are added to the graph shown in FIG. 2B.

As shown in FIG. 2A, a regression curve of the formula (1-2) is obtained from four points' measured values, and M(T=0) and $T_c$ calculated by Kuzmin's formula are determined from the regression curve. Meanwhile, as shown in FIG. 2B, there is an error between M(T=0) and $T_c$ calculated by first principles calculation and M(T) and $T_c$ calculated by Kuzmin's formula. However, the error is reduced by data assimilation. Specifically, M(T) calculated by first principles calculation and four points' measured values are subjected to data assimilation, and M(T=0) and $T_c$ are obtained from the data assimilation curve. This is performed with respect to M(T=0) and $T_c$ calculated by first principles calculation for all compositions. If the measured values are measured for that composition, like the composition 1 in Table 2 and Table 3, the measured values and M(T=0) and $T_c$ calculated by first principles calculation for that composition are respectively subjected to data assimilation. In this case, there is no need to assimilate all compositions with the measured values. In other words, it is only necessary to assimilate at least one composition with the measured values. For example, in the case of Table 4, data assimilation is performed for only the composition 1. Meanwhile, when there are no measured values for that composition, like the compositions 4 to 7, M(T=0) and $T_c$ calculated by first principles calculation for that composition, and data of the composition with the measured values are assimilated.

In the third step, the prediction model formula derived in the second step, i.e., the above formulas (2) and (3) is applied to the above formula (1-2) to expand the saturation magnetization at absolute zero M(x, y, z, T=0) to the saturation magnetization at finite temperature M(x, y, z, T). Therefore, it is possible to predict the saturation magnetization at finite temperature for the magnetic phase having any composition represented by x, y, and z.

The first step 10, the second step 20, and the third step 30 described with FIG. 1 are written in a computer program language to give a saturation magnetization prediction simulation program, which can be executed on a computer device. With respect to FIG. 1, "saturation magnetization prediction method 50 of the present disclosure" can be replaced by "saturation magnetization prediction simulation program 60 of the present disclosure".

There is no particular limitation on programming language as long as it is adapted to machine learning. Examples of programming language include Python, Java (registered trademark), R, C++, C, Scala, and Julia. These languages may be used in combination. In particular, in the case of using Python, well-known modules required for machine learning can be used.

The measured data of the first step is entered using an input device. A well-known device, such as a keyboard, can be used as the input device. The input device includes a device which can be entered automatically via an interface from a sensor capable of sensing the saturation magnetization and/or temperature. The calculation performed in the first step, the second step, and the third step can be executed using a CPU device. There is no particular limitation on the CPU device as long as the program language describing the saturation magnetization prediction simulation program can be executed. The saturation magnetization at finite temperature obtained through the first step, the second step, and the third step can be output using an output device. A well-known device such as a display device can be used as the output device.

The saturation magnetization prediction simulation program of the present disclosure may have a program code which is recorded on a recording medium, or printed out on paper media. As the recording medium, a well-known medium may be used. Examples of the recording media include semiconductor recording media, magnetic recording media, and magneto-optical recording media. These media may be used in combination.

[Examples]

The rare earth magnet of the present disclosure will be described in more detail by way of Examples. The rare earth magnet of the present disclosure is not limited to the conditions used in the following Examples.

With respect to the rare earth magnet including a magnetic phase having the composition represented by $(Nd_{(1-x-y)}La_xCe_y)_2(Fe_{(1-z)}Co_z)_{14}B$, the following was performed. Using the measured values of Example 1 and Example 2, and Comparative Example 1 and Comparative Example 2 shown in Table 5, the formulas (1) to (3) were obtained through the first step, the second step, and the third step mentioned above.

TABLE 5

| | Type of data | La content x | Ce content y | Co content z | Saturation magnetization at 453 K M(x, y, z , T = 453) (T: Tesla) | Saturation magnetization at z = 0 M(x, y, z = 0, T = 453) (T: Tesla) | Gain |
|---|---|---|---|---|---|---|---|
| Example 1 | Measured value | 0.33 | 0.33 | 0.30 | 1.15 | 1.04 | 0.11 |
| Example 2 | Measured value | 0.50 | 0.50 | 0.30 | 1.16 | 0.92 | 0.24 |

TABLE 5-continued

| | Type of data | La content x | Ce content y | Co content z | Saturation magnetization at 453 K M(x, y, z , T = 453) (T: Tesla) | Saturation magnetization at z = 0 M(x, y, z = 0, T = 453) (T: Tesla) | Gain |
|---|---|---|---|---|---|---|---|
| Example 3 | Data assimilation | 0.33 | 0.33 | 0.10 | 1.09 | 1.04 | 0.05 |
| Example 4 | Data assimilation | 0.33 | 0.33 | 0.40 | 1.06 | 1.04 | 0.02 |
| Example 5 | Data assimilation | 0.50 | 0.17 | 0.20 | 1.11 | 1.08 | 0.03 |
| Example 6 | Data assimilation | 0.50 | 0.17 | 0.30 | 1.10 | 1.08 | 0.02 |
| Example 7 | Data assimilation | 0.03 | 0.03 | 0.10 | 1.33 | 1.28 | 0.05 |
| Example 8 | Data assimilation | 0.03 | 0.03 | 0.40 | 1.31 | 1.28 | 0.03 |
| Example 9 | Data assimilation | 0.03 | 0.10 | 0.30 | 1.29 | 1.23 | 0.06 |
| Example 10 | Data assimilation | 0.03 | 0.20 | 0.40 | 1.22 | 1.18 | 0.04 |
| Comparative Example 1 | Measured value | 0 | 0 | 0 | 1.27 | 1.27 | 0 |
| Comparative Example 2 | Measured value | 0 | 0 | 0.70 | 1.17 | 1.27 | −0.10 |
| Comparative Example 3 | Data assimilation | 0.50 | 0.17 | 0 | 1.08 | 1.08 | 0 |
| Comparative Example 4 | Data assimilation | 0.50 | 0.50 | 0 | 0.92 | 0.92 | 0 |
| Comparative Example 5 | Data assimilation | 0.33 | 0.33 | 0 | 1.04 | 1.04 | 0 |
| Comparative Example 6 | Data assimilation | 0.03 | 0.03 | 0 | 1.28 | 1.28 | 0 |
| Comparative Example 7 | Data assimilation | 0.50 | 0.17 | 0.60 | 0.98 | 1.08 | −0.10 |
| Comparative Example 8 | Data assimilation | 0.33 | 0.33 | 0.60 | 0.98 | 1.04 | −0.06 |
| Comparative Example 9 | Data assimilation | 0.03 | 0.20 | 0 | 1.18 | 1.18 | 0 |

In the case of determining the measured values of the saturation magnetization, samples were prepared by the following procedure and the saturation magnetization of the samples was measured.

Raw materials with each composition shown in Table 5 were arc-melted and solidified to prepare a solidified ingot. The ingot was subjected to a heat treatment in an argon gas atmosphere at 1,373 K for 12 hours. The size of the magnetic phase in the ingot was 80 to 120 μm. Chemical composition analysis was performed by inductively coupled plasma (ICP) emission spectrometry and the volume fraction (%) of the magnetic phase was determined from the difference with a stoichiometric ratio of $R_2(Fe, Co)_{14}B$.

The ingot after subjecting to the heat treatment was crushed to obtain a magnetic powder. Using a vibrating sample magnetometer (VSM), an M-H curve was measured. The saturation magnetization of the entire sample (all of the magnetic powder) was calculated from the M-H curve by the law of approach to saturation magnetization, and the calculated value was divided by {(volume fraction (%) of magnetic phase)/100} to obtain the value of the saturation magnetization of the magnetic phase.

The rare earth magnet of the present disclosure is Example if the above gain is more than 0 in Table 5 since x, y, and z satisfy M(x, y, z, T)>M(x, y, z=0, T).

Figure 4:
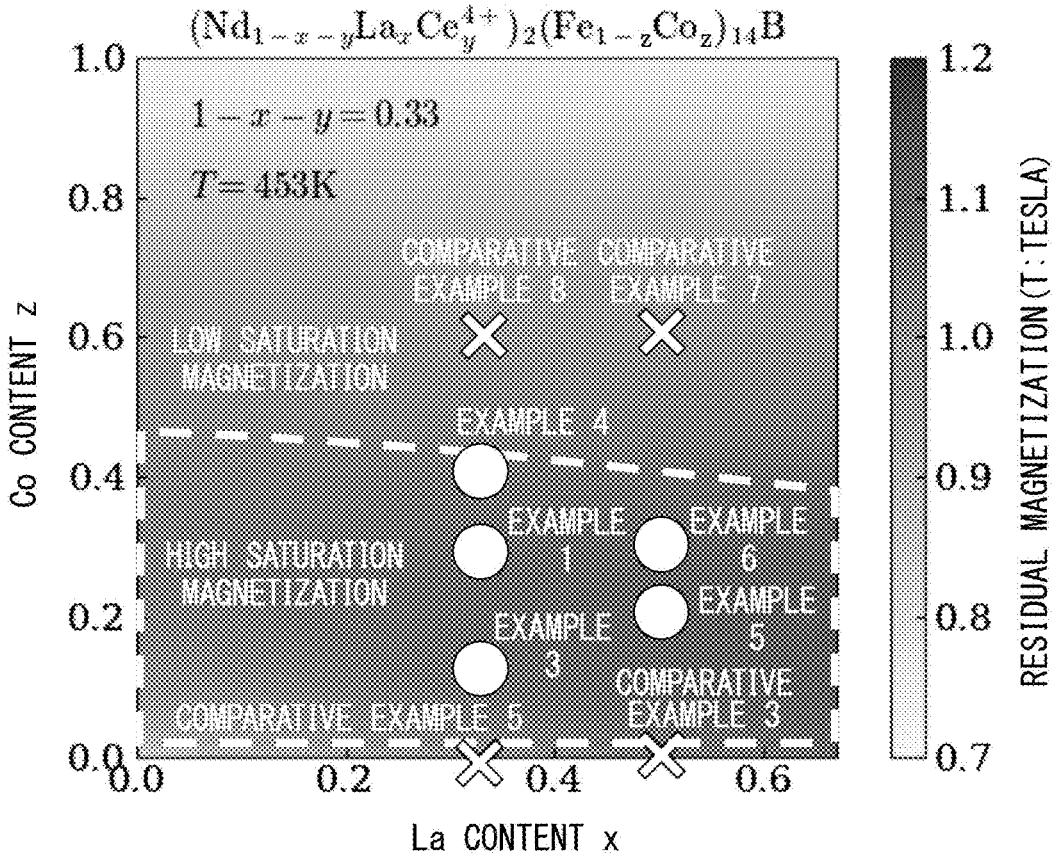
FIG. 4 is a graph showing the saturation magnetization when T=453 and 1–x–y=0.33 are satisfied by a relationship between the La content x and the Co content z with regard to the formulas (1) to (3).

FIG. 4 is a graph showing the saturation magnetization when T=453 and 1−x−y=0.33 are satisfied by a relationship between the La content x and the Co content z for the formulas (1) to (3). From FIG. 4, it is possible to understand that the saturation magnetization at 453 K in Examples 1, 3, and 4 to 6 is higher than the saturation magnetization at 453 K in Comparative Examples 3, 5, and 7 to 8.

Figure 5:
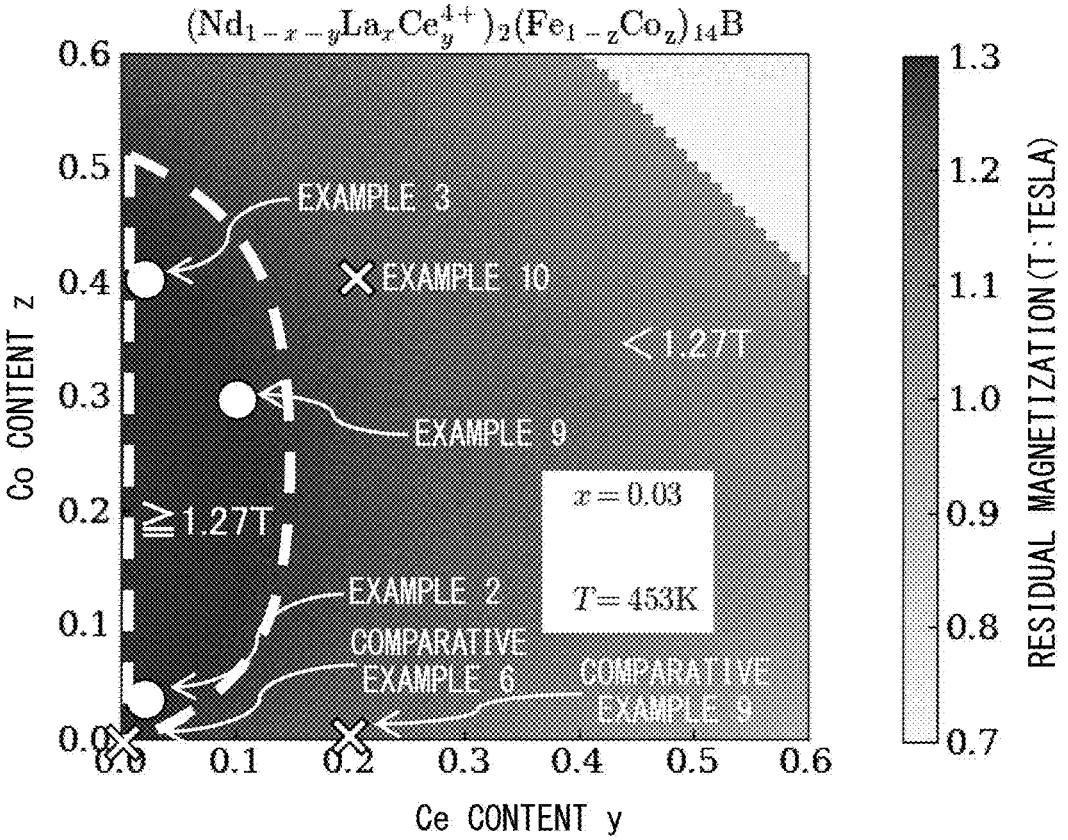
FIG. 5 is a graph showing the saturation magnetization when T=453 and x=0.03 are satisfied by a relationship between the Ce content y and the Co content z with regard to the formulas (1) to (3).

FIG. 5 is a graph showing the saturation magnetization when T=453 and x=0.03 are satisfied by a relationship between the Ce content y and the Co content z for the formulas (1) to (3). The graph is shown in relation to the percentage of Ce content y and the percentage of Co content z. From FIG. 5, it is possible to understand that the saturation magnetization of Examples 2 to 3 and 9 is more than the saturation magnetization (1.27 Tesla) of Comparative Example 1 in which part of Nd is not substituted with La and Ce, and part of Fe is not substituted with Co at 453 K.

Figure 6:
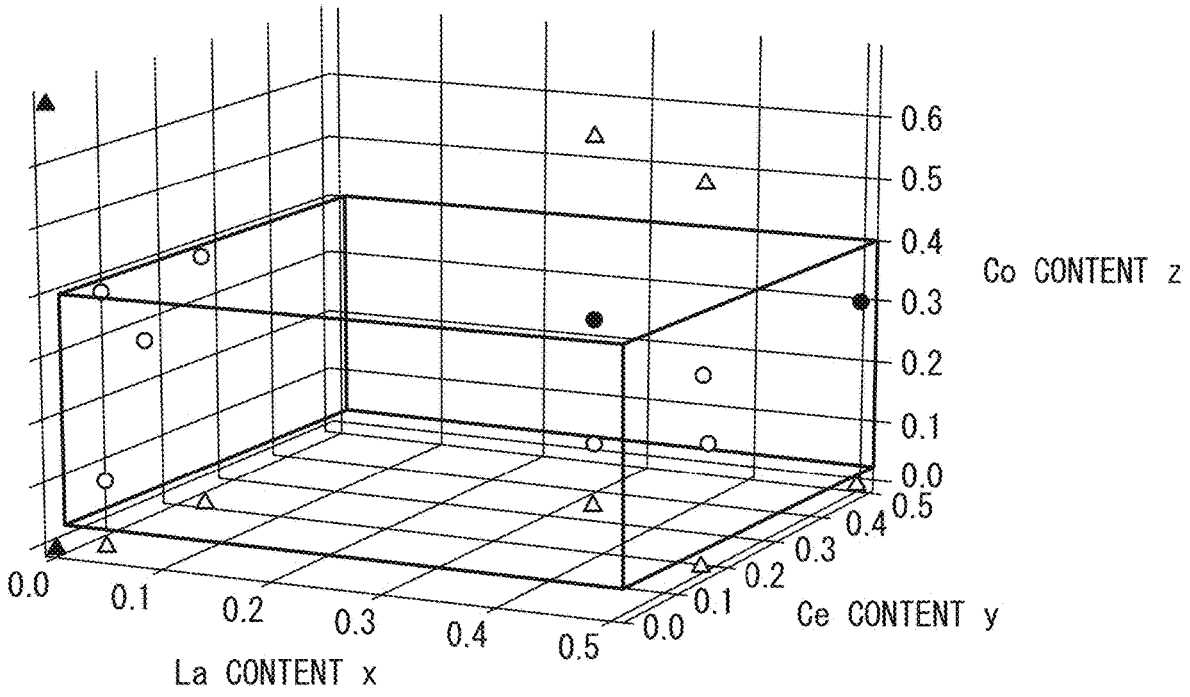
FIG. 6 shows a relationship among x, y, and z with regard to the data group in Table 5.

FIG. 6 shows a relationship among x, y, and z for the data group in Table 5. From FIG. 6, it is possible to understand that the gain of the magnetic phase with the composition satisfying 0.03≤x≤0.50, 0.03≤y≤0.50, and 0.05≤z≤0.40 is more than 0 in the data group in Table 5.

These results revealed the effects of the rare earth magnet of the present disclosure.

DESCRIPTION OF NUMERICAL REFERENCES

10 First step
20 Second step
30 Third step
50 Saturation magnetization prediction method of the present disclosure
60 Saturation magnetization prediction simulation program of the present disclosure
100 Rare earth magnet of the present disclosure
110 Magnetic phase
120 Grain boundary phase

The invention claimed is:

1. A rare earth sintered magnet comprising a single-phase magnetic phase that is prepared by sintering a magnetic powder comprising the single-phase magnetic phase, the single-phase magnetic phase in the magnetic powder having a size in the range of from 1 to 500 μm and having the composition represented by the formula $(Nd_{(1-x-y)}La_xCe_y)_2(Fe_{(1-z)}Co_z)_{14}B$ in an atomic ratio, wherein x, y, and z in the formula in an atomic ratio satisfy a relationship represented by the following formulas (1) to (3), and a material parameters of the following formula (1) is 0.60, $$\mu_0 M(x, y, z, T) = \mu_0 M(x, y, z, T = 0) \left[1 - s\left(\frac{T}{T_c(x, y, z)}\right)^{\frac{3}{2}} - (1 - s)\left(\frac{T}{T_c(x, y, z)}\right)^{\frac{5}{2}}\right]^{\frac{1}{3}} \quad \text{Formula (1)}$$

$\mu_0$: vacuum permeability ($N/A^2$)

M(x,y,z,T): saturation magnetization at finite temperature (T)

M(x,y,z,T=0): saturation magnetization at absolute zero (T)

s: material parameter (−)

T: finite temperature (KS)

$T_c$: Curie temperature (K)

$$\mu_0 M(x,y,z,T=0)=1.799-0.411x-0.451y-0.593z-0.011x^2+0.002y^2-0.070z^2-0.002xy-0.058yz-0.040zx \quad \text{Formula (2)}$$

$\mu_0$: vacuum permeability ($N/A^2$)

M(x,y,z,T=0): saturation magnetization at absolute zero (T)

$$T_c(x,y,z)=588.894-5.825x-135.713y+506.799z+1.423x^2+10.016y^2-69.174z^2+125.862xy+15.110yz-12.342zx \quad \text{Formula (3)}$$

wherein z in the formula in an atomic ratio satisfies $0.30 \leq z \leq 0.40$, wherein x and y in the formula in an atomic ratio satisfy $0.03 \leq x \leq 0.50$ and $0.03 \leq y \leq 0.50$, respectively, and wherein the value represented by M(x, y, z, T=453)−M(x, y, z=0, T=453) is 0.02 to 0.24.

2. The rare earth magnet according to claim 1, wherein a volume fraction of the magnetic phase is 90.0 to 99.0% relative to the entire rare earth magnet and the remaining balance is a grain boundary phase.

* * * * *